United States Patent [19]

Etoh et al.

[11] 4,304,208

[45] Dec. 8, 1981

[54] INTERNAL COMBUSTION ENGINE

[75] Inventors: Yukihiro Etoh, Yokohama; Toshiaki Tanaka, Fujisawa, both of Japan

[73] Assignee: Nissan Motor Company, Limited, Yokohama, Japan

[21] Appl. No.: 133,897

[22] Filed: Mar. 25, 1980

[30] Foreign Application Priority Data

Mar. 26, 1979 [JP] Japan ..... 54-39068[U]

[51] Int. Cl.[3] ..... F01N 3/15; F02D 17/00

[52] U.S. Cl. ..... 123/568; 123/198 F; 123/569; 123/571

[58] Field of Search ..... 123/568, 569, 570, 571, 123/198 F

[56] References Cited

U.S. PATENT DOCUMENTS

| | | | |
|---|---|---|---|
| 4,107,921 | 8/1978 | Iizuka | 123/198 F |
| 4,186,715 | 2/1980 | Iizuka et al. | 123/198 F |
| 4,201,180 | 5/1980 | Iizuka | 123/568 |
| 4,231,338 | 11/1980 | Sugasawa et al. | 123/568 |

FOREIGN PATENT DOCUMENTS

| | | | |
|---|---|---|---|
| 55-51926 | 4/1980 | Japan | 123/198 F |
| 55-66637 | 5/1980 | Japan | 123/568 |

*Primary Examiner*—Parshotam S. Lall

*Attorney, Agent, or Firm*—Schwartz, Jeffery, Schwaab, Mack, Blumenthal & Koch

[57] ABSTRACT

An internal combustion engine is disclosed which includes active cylinders being always active and inactive cylinders being inactive when the engine is below a predetermined value. The engine has an exhaust passage divided by a partition into first and second branches leading from the active and inactive cylinders. The second branch is connected through an EGR passage with the inactive cylinders at low load conditions. An exhaust gas sensor is provided in a through-hole formed in the partition at a position downstream of the opening of the EGR passage for monitoring one content of the engine exhaust to provide a signal indicative of the air/fuel ratio. The second branch has a volume, upstream of the opening of the EGR passage, larger than the stroke volume of the inactive cylinders.

6 Claims, 4 Drawing Figures

INTERNAL COMBUSTION ENGINE

BACKGROUND OF THE INVENTION

1. Field of the Invention

This invention relates to an internal combustion engine of the split type including active cylinders being always active and inactive cylinders being inactive below a given engine load and, more particularly, to such an engine having in its exhaust passage an exhaust gas sensor for feedback control to ensure that the fuel supplied to the engine is correct to maintain a desirted optimum air/fuel ratio.

2. Description of the Prior Art

It is generally known that internal combustion engines demonstrate higher fuel combustion and thus higher fuel economy when running under higher load conditions. In view of this fact, split type internal combustion engines have already been proposed as automotive vehicle engines or the like subjective proposed as automotive vehicle engines or the like subjective to frequent engine load variations. Such split type internal combustion engines include active cylinders being always active and inactive cylinders being inactive when the engine load is below a given value. At low load conditions, the flow of fuel and air to the inactive cylinders is cut off so that the engine operates only on the active cylinders for relatively increasing active cylinder loads resulting in high fuel economy.

A split type internal combustion engine has been proposed which is associated with an exhaust gas recirculation system for re-introduction of a great amount of exhaust gases into the inactive cylinders to minimize inactive cylinder pumping losses during a split engine operation and also with an air/fuel ratio sensor adapted to provide a feedback signal for maintaining the air/fuel ratio of the mixture in each cylinder at the stoichiometric value. Such a split type internal combustion engine exhibits much higher fuel economy.

One difficulty with such conventional split type internal combustion engine is that the exhaust gas sensor is exposed to the exhaust gases re-introduced into the inactive cylinders and discharged therefrom while the engine is operating in a split cylinder mode of operation under low load conditions. This causes a reduction of the temperature of the exhaust gas sensor to spoil its performance and also provides previous air/fuel ratio indicative information to the exhaust gas sensor resulting in improper air/fuel ratio control.

SUMMARY OF THE INVENTION

It is therefore one object of the present invention to provide an improved split type internal combustion engine which has high fuel economy and a minimam level of air pollutants.

Another object of the present invention is to provide an engine exhaust system conductive to maximum oxygen sensor performance and thus to maximum catalytic converter performance.

BRIEF DESCRIPTION OF THE DRAWINGS

The present invention will be described in greater detail by reference to the following description take in connection with the accompanying drawings, in which.

DESCRIPTION OF THE PREFERRED EMBODIMENTS

Figure 1:
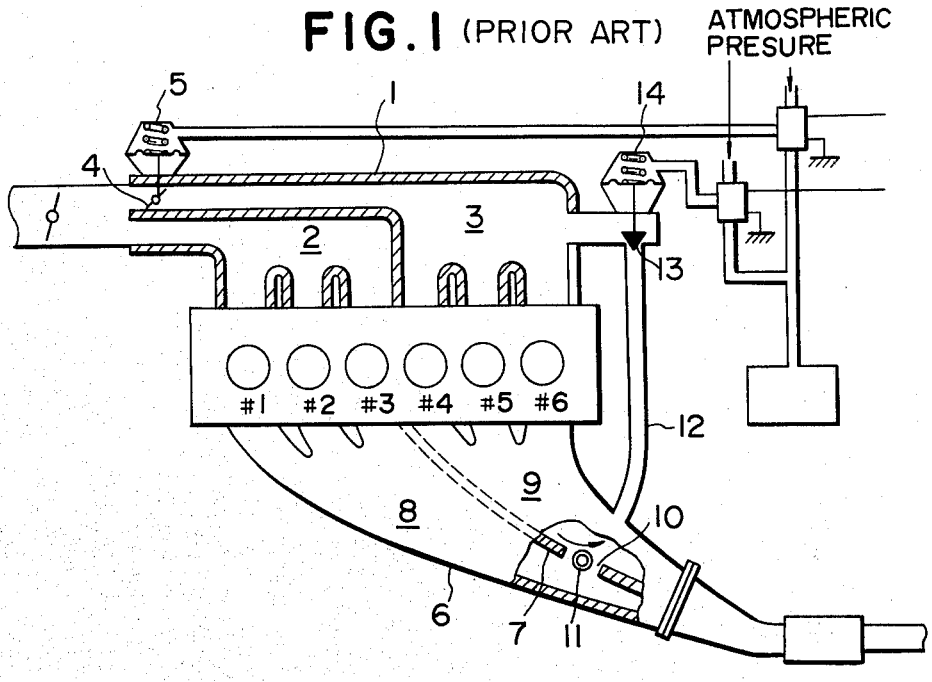
FIG. 1 (PRIOR ART)
FIG. 1 is a schematic sectional view showing a conventional split type internal combustion engine.

Prior to the description of the preferred embodiments of the present invention, we shall briefly describe the prior art split type internal combustion engine in FIG. 1 in order to specifically point out the difficulties attendant thereon.

Referring to FIG. 1, the split engine includes six cylinders #1 to #6, the first three cylinders #1 to #3 being always active and referred hereinafter to as active cylinders while the other three cylinders #4 to #6 being inactive below a predetermined engine load and referred thereinafter to as inactive cylinders. Air is introduced through an intake manifold 1 of the divided header type having first and second intake passages 2 and 3 separated from each other. The first intake passage 2 is for supplying air to the active cylinders #1 to #3 and the second intake passage 3 is for supplying air to the inactive cylinders #4 to #6. The second intake passage 3 has therein a stop valve 4, the operation of which is controlled by means of a pneumatic valve actuator 5 to close the second intake passage 3 so as to cut off the flow of air to the inactive cylinders #4 to #6 during a three cylinder mode of operation.

The engine also has an exhaust duct 6 divided by a partition 7 into first and second exhaust passage 8 and 9 leading from the active and inactive cylinders, respectively. The partition 7 is formed with a throughhole 10 in which an oxygen sensor 11 is provided such that it can be maintained at suitable temperatures to ensure its operation, in all modes of operation of the engine including cold engine starting and low speeds, to provide a signal indicative of the air/fuel ratio at which the engine is operating for feedback control of the air/fuel ratio to satisfy the stoichiometric. An exhaust gas recirculation (EGR) passage 12 is provided which has its one end opening into the second exhaust passage 9 and the other end opening into the second intake passage 3. The EGR passage 12 has therein an EGR valve 13, the operation of which is controlled by means of a pneumatic valve actuator 14 to open the EGR passage 12 so as to allow reintroduction of exhaust gases into the second intake passage 3 during a three cylinder mode of operation.

In such a conventional arrangement, the oxygen sensor 11 is located in the through-hole 10 facing the opening of the EGR passage 12 so that it can be exposed to the flow of exhaust gases discharged through the second exhaust passage 9 from the inactive cylinders #4 to #6 as well as the flow of exhaust gases discharged through the first exhaust passage 8 from the active cylinders #1 to #3. This is reasonable in monitoring the average oxygen content of the engine exhaust during a six cylinder mode of operation. During a three cylinder mode of operation, however, the exhaust gases flowing over the oxygen sensor 11 includes a part produced by combustions rather previously taken place in the inactive cylinders and recirculated thereinto. This causes a reduction in the temperature of the exhaust gas sensor to spoil its performance and also introduction of previous air/fuel ratio indicative information into the output of the oxygen sensor, resulting in inaccurate air/fuel ratio feedback control.

Figure 2:
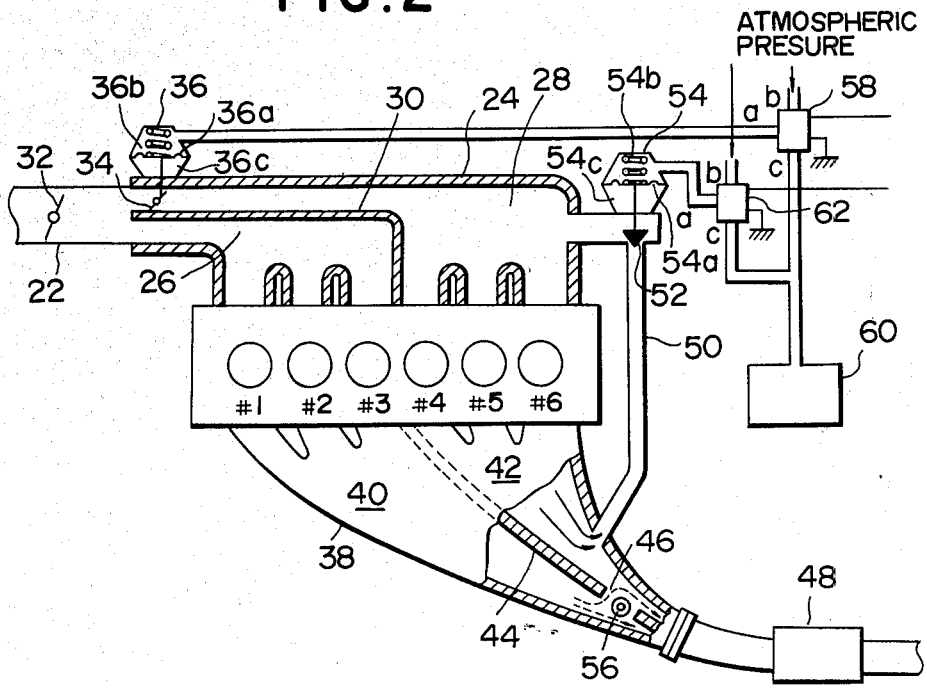
FIG. 2 is a schematic sectional view showing a preferred embodiment of a split engine constructed in accordance with the present invention.

Referring to FIG. 2, there is illustrated one preferred embodiment of a split engine constructed in accordance with the present invention. Although the engine is shown as including three active cylinders #1 to #3 and three inactive cylinders #4 to #6, it is to be noted that the particular engine shown is only for illustrative purposes and the structure of this invention could be readily applied to any split engine structure.

Air to the engine is supplied through an air induction passage 22 to an intake manifold 24 of the divided header type having first and second intake passages 26 and 28 separated by an partition 30. The first intake passage 26 is for supplying air to each of the active cylinders #1 to #3 and the second intake passage 28 is for supplying air to each of the inactive cylinders #4 to #6. The air induction passage 22 is provided therein with a throttle valve 32. The second intake passage 28 is provided therein with a stop valve 34 at a position just downstream of its inlet opening. The stop valve 34 is adapted to close so as to cut off communication between the first and second intake passages 26 and 28. The opening and closing of the stop valve 34 is effected by a first pneumatic valve actuator 36 as will be described in detail.

The engine has also an exhaust manifold 38 which is divided into first and second exhaust passages 40 and 42 by a partition 44 and connected to an exhaust duct having therein a three-way catalytic converter 48. The catalystic converter 48 effects oxidation of HC and CO and reduction of NOx so as to minimize the emission of pollutants through the exhaust duct. The catalystic converter 48 offers its maximum performance at the stoichiometric air/fuel ratio. An exhaust gas recirculation (EGR) passage 50 is provided which has its one end opening into the second exhaust passage 42 and the other end opening into the downstream side of the second intake passage 28. The EGR passage 50 has therein an EGR valve 52 adapted to open so as to allow recirculation of exhaust gases into the second intake passage 28. The opening and closing of the EGR valve 52 is effected by a second pneumatic valve actuator 54 as will be described in detail.

The partition 44 is formed with a through-hole 46 at a position downstream of the opening of the EGR passage 50 for receiving an exhaust gas sensor such as an oxygen sensor 56. Preferably, the oxygen sensor 56 is spaced apart from the opening of the EGR passage 50 a distance of 25 mm or more. During a six cylinder mode of operation, the oxygen sensor 56 is exposed to the exhaust gases discharged from all of the cylinders #1 to #6 to monitor the average oxygen content of the exhaust gases flowing thereover and detect the air/fuel ratio at which the engine is operating. The oxygen sensor 56 provides a feedback signal indicative of the air/fuel ratio to control means (not shown) to ensure that the fuel supplied to the engine is correct to maintain a desired optimum air/fuel ratio, i.e., the stoichiometric air/fuel ratio.

The oxygen sensor 56 should be always maintained above a predetermined temperature to have its performance held high. In order to prevent the direct arrival of the exhaust gases from the inactive cylinders #4 to #6 to the oxygen sensor 56, the second exhaust passage 42 is designed to have a volume, upstream of the opening of the EGR passage 50, larger than the stroke volume of the inactive cylinders #4 to #6 and also the oxygen sensor 56 is located at a position downstream of the opening of the EGR passage 50.

The first pneumatic valve actuator 36 includes a flexible diaphragm **36*a* mounted between a pair of housings to form therewith chambers 36*b* and 36*c* on opposite sides of the diaphragm 36*a*. A rod is centrally fixed to the diaphragm 36*a* and extends through the opening in the chamber 36*c* to the stop valve 34. A spring is disposed in the working chamber 36*b* to urge the diaphragm 36*a* downwardly. The working chamber 36*b* is connected to the outlet 58*a* of a first three-way solenoid valve 58. The solenoid valve 58 has an atmosphere inlet 58*b* connected to the atmospheric air and a vacuum inlet 58*c* connected to a vacuum tank 60 held at a predetermined vacuum. The second pneumatic valve actuator 54 associated with the EGR valve 52 is substantially similar in structure to the first pneumatic valve actuator 36. The working chamber 54*b* of the second valve actuator 54 is communicated with the outlet 62*a* of a second threeway solenoid valve 62. The second solenoid valve 62 has an atmosphere inlet 62*b* connected to the atmospheric air and a vacuum inlet 62*c* communicated with the vacuum tank 60**.

When the engine load is below a predetermined value, the first and second solenoid valves 58 and 62 establish communication between their vacuum inlets c and their outlets a to introduce vacuum from the vacuum tank 60 to the working chambers **36*b* and 54*b* so as to close the stop valve 34 and open the EGR valve 52. At high load conditions, the first and second solenoid valves 58 and 62 provide communication between their atmosphere inlets b and their outlets a to introduce atmospheric pressure to the working chambers 36*b* and 54*b* so as to open the stop valve 34 and close the EGR valve 52. The operation of the first and second three-way solenoid valves 58 and 92** may be controlled by split engine control means responsive to engine loads for cutting off the supply of fuel to the inactive cylinders when the engine load is below a predetermined value.

The operation of the split engine of the present invention will now be described. Assuming that the engine load is above a predetermined value, the first and second solenoid valves 58 and 60 are responsive to the split engine control system for providing communication between their atmosphere inlets b and their outlets a so as to introduce atmospheric pressure into the working chambers **36*b* and 54*b* of the first and second valve actuators 36 and 54, respectively. As a result, the stop valve 34 opens to allow the flow of fresh air into the inactive cylinders while at the same time the EGR valve 52** closes to interrupt exhaust gas recirculation, so that the engine is placed in a full cylinder mode of operation.

In this state of the engine, the oxygen sensor 56 is exposed to the exhaust gases discharged from the active cylinders #1 to #3 and the exhaust gases dicharged from the inactive cylinders #4 to #6, both of which are high temperature exhaust gases produced by combustions taken placed substantially at a time and reach the oxygen sensor 56 just after the combustions. Thus, the oxygen sensor 56 is held at high temperature conductive to its maximum of performance so that the air/fuel ratio at which the engine is operating can be held at the stoichiometric. This is conductive to the maximum performance of the three-way catalytic converter 48 so as to minimize the emission of pollutants through the exhaust dust.

When the engine load falls below the predetermined value, the first and second solenoid valves 58 and 60 are responsive to the split engine control system which cuts off the supply of fuel to the inactive cylinders #4 to #6 for communicating their outlets a with their vacuum inlets c so as to introduce vacuum into the working chambers 36*b* and 54*b* of the first and second valve actuator 36 and 54, respectively. As a result, the stop valve 34 closes to cut off the flow of fresh air to the inactive cylinders #4 to #6 and at the same time the EGR valve 52 opens to allow recirculation of a great amount of exhaust gases into the inactive cylinders #4 to #6, so that the engine is placed in a split cylinder mode of operation where the engine operates only on the active cylinders #1 to #3.

In this state of the engine, the loads on the active cylinders #1 to #3 increase relatively due to the suspension of operation of the inactive cylinders #4 to #6 and the pumping losses in the inactive cylinders #4 to #6 are reduced by recirculation of a great amount of exhaust gases therethrough, resulting in improved fuel economy.

Since the opening of the EGR passage 50 is formed at a point upstream of the oxygen sensor 56 and the second exhaust passage 42 is designed to have a volume, upstream of the opening of the EGR passage 50, larger than the stroke volume of the inactive cylinders #4 to #6, most of the cooled exhaust gases discharged from the inactive cylinders #4 to #6 on every exhaust stroke of each piston, flows into the EGR passage 50, as indicated by the solid arrows of FIG. 2, and does not flow over the oxygen sensor 56. Thus, the oxygen sensor 56 is exposed only to the high temperature exhaust gases discharged from the active cylinders #1 to #3, as shown by the broken arrows of FIG. 2, so that the oxygen sensor 56 is held at high temperature conductive to its maximum performance and the air/fuel ratio at which the engine is operating can be held at the stoichiometric. This is conductive to the maximum performance of the three-way catalytic converter 48 so as to minimize the emission of pollutants through the exhaust duct.

Figure 3:
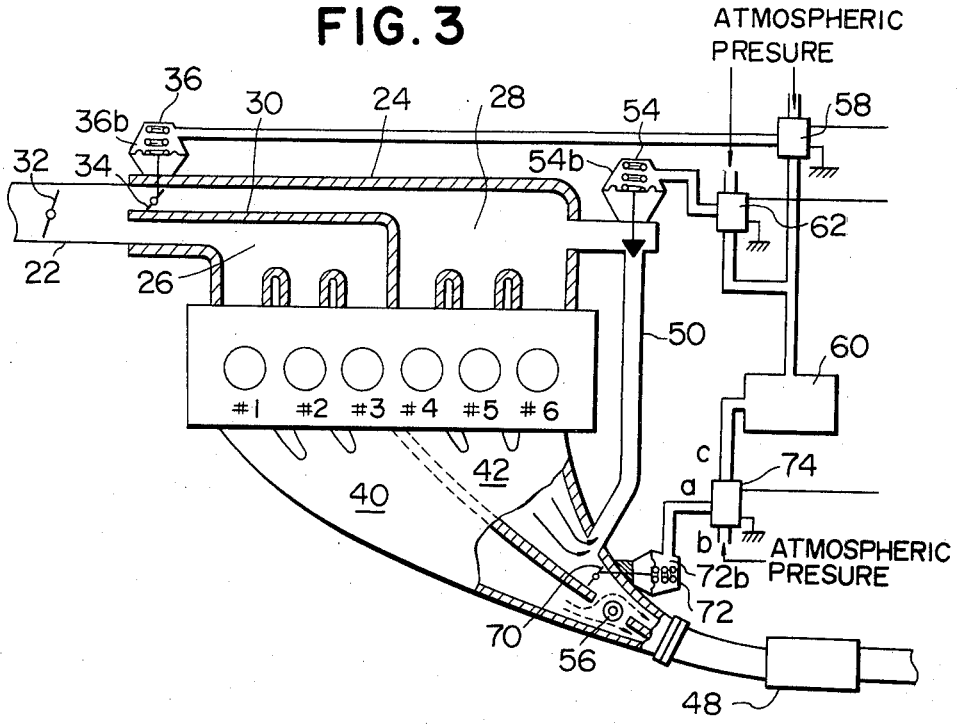
FIG. 3 is a schematic sectional view showing a second embodiment of the present invention.

Referring to FIG. 3, there is illustrated a second embodiment in which like parts are designed by like reference numerals. The chief difference between the first and second embodiments is that valve means 70 is provided at a position upstream of the oxygen sensor 56 and downstream of the opening of the EGR passage 50. The opening and closing of the valve means 70 is controlled by a third pneumatic valve actuator which is substantially similar is structure to the first penumatic valve actuator 36. The working chamber 72*b* of the third valve actuator 72 is connected with the outlet 74*a* of a third three-way solenoid valve 74. The third solenoid valve 74 has an atmosphere inlet 74*b* connected to the atmospheric air and a vacuum inlet 74*c* connected to the vacuum tank 60.

The third solenoid valve 74 is responsive to the split engine control means to provide communication between its atmosphere inlet 74*b* and its outlet 74*a* so as to introduce atmospheric pressure into the working chamber 72*b* of the third valve actuator 72, thereby opening the valve means 70 when the engine load is above a predetermined value. At low load conditions, the third solenoid valve 74 establishes communication between its vacuum inlet 74*c* and its outlet 74*a* so as to introduce vacuum into the working chamber 72*b* of the third valve actuator 72, thereby closing the valve means 70.

During a split cylinder mode of operation, the valve means 70 closes the second exhaust passage 42 to ensure that the whole amount of exhaust gases discharged from the inactive cylinders #4 to #6 can flow into the EGR passage 50 and the oxygen sensor 56 can be exposed only to the high temperature exhaust gases discharged from the active cylinders #1 to #3. Accordingly, the oxygen sensor 56 is held at high temperature conductive to its maximum performance and the air/fuel ratio at which the engine is operating can be held at the stoichiometric. This is conductive to the maximum performance of the three-way catalytic converter 48 so as to minimize the emission of pollutants through the exhaust duct.

Figure 4:
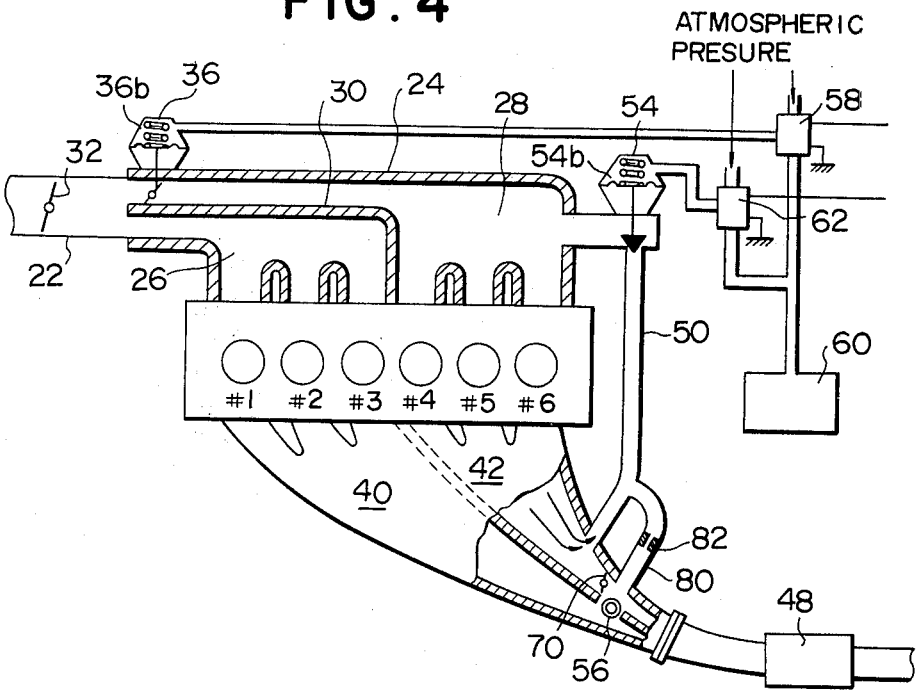
FIG. 4 is a schematic sectional view showing a third embodiment of the present invention.

Referring to FIG. 4, there is illustrated a third embodiment of the present invention in which like parts are designated by like reference numerals. In this embodiment, a passage 80 is further provided which has its one end opening into the second exhaust passage 42 at a position facing the oxygen sensor 56 and the other end opening into the EGR passage 50. The passage 80 has therein an orifice 82. During a split cylinder mode of operation where the valve means 70 is closed, the passage 80 provides communication between the second exhaust passage 42 and the exhaust duct. This is effective to eliminate the possibility of occurrence of an excessive pressure difference between the active and inactive cylinders. If the exhaust gases discharged from the inactive cylinders flow through the passage 80, there is no problem since they cannot flow over the oxygen sensor 56.

In accordance to the present invention, the oxygen sensor is provided at a position downstream of the opening of the EGR passage and also the second exhaust passage is designed to have a volume, upstream of the opening of the EGR passage, larger than the stroke volume of the inactive cylinders. This is effective to hole the oxygen sensor at high temperature during a split cylinder mode of opertion. Accordingly, the performance of the oxygen sensor is always high to provide accurate feedback control of the air/fuel ratio and thus the performance of the catalytic converter is held high to minimize the emission of pollutants through the exhaust duct.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) a plurality of cylinders split into first and second groups;

(b) an intake passage divided into first and second branches for supplying air to said first and second groups of cylinders, respectively, said second intake passage branch provided near its inlet with a stop valve normally open to allow the flow of air into said second group of cylinders;

(c) an exhaust passage divided by a partition into first and second branches leading from said first and second groups of cylinders, respectively;

(d) an EGR passage having its one end opening into said second exhaust passage branch and the other end opening into said second intake passage branch downstream of said stop valve, said EGR passage having therein an EGR valve normally closed to interrupt recirculation of exhaust gases into said second intake passage branch;

(e) an exhaust gas sensor provided in a through-hole formed in said partition at a position downstream of said one end of said EGR passage for monitoring one content of the engine exhaust to provide a signal indicative of the air/fuel ratio at which said engine is operating;

(f) split engine control means responsive to engine loads for cutting off the supply of fuel to said second group of cylinders, closing said stop valve, and opening said EGR valve when the engine load is below a predetermined value; and (g) said second exhaust passage branch has a volume, upstream of said one end of said EGR passage, larger than the stroke volume of said second group of cylinders.

2. An internal combustion engine according to claim 1, wherein said exhaust gas sensor is spaced from said one end of said EGR passage a distance longer than 25 mm.

3. An internal combustion engine according to claim 1, wherein said exhaust gas sensor is in the form of an oxygen sensor responsive to the oxygen content of the engine exhaust for providing a signal indicative of the air/fuel ratio at which said engine is operating.

4. An internal combustion engine according to claim 1, which further comprises valve means provided in said second exhaust passage branch at a position downstream of said one end of said EGR passage and upstream of said exhaust gas sensor, said valve means responsive to said split engine control means for closing said second exhaust passage branch when the engine load is below said predetermined value.

5. An internal combustion engine according to claim 4, which further comprises a passage having its one end opening into said EGR passage and the other end opening into said second exhaust passage branch at a position facing to said exhaust gas sensor.

6. An internal combustion engine according to claim 5, wherein said passage has therein an orifice.

* * * * *